US007082620B1

(12) United States Patent
Rongione

(10) Patent No.: US 7,082,620 B1
(45) Date of Patent: Aug. 1, 2006

(54) HEAD PROTECTIVE DEVICE INCORPORATING A SWEATBAND BANDANA

(75) Inventor: Donald J. Rongione, Adamstown, PA (US)

(73) Assignee: GWB, Inc., Wilmington, DE (US)

( * ) Notice: Subject to any disclaimer, the term of this patent is extended or adjusted under 35 U.S.C. 154(b) by 0 days.

(21) Appl. No.: 11/149,247

(22) Filed: Jun. 10, 2005

(51) Int. Cl.
*A42B 1/00* (2006.01)

(52) U.S. Cl. ..... 2/181; 2/175.1; 2/175.2; 2/175.3; 2/6.2; 2/410; 2/417; 2/418; 2/209.12; 2/209.13; 2/206; 2/207; 2/184.5

(58) Field of Classification Search ..... 2/175.1, 2/175.2, 175.3, 6.2, 410, 417, 418, 171.4, 2/209.12, 209.13, 207, 206, 181, 184.5, 174, 2/279; 132/58
See application file for complete search history.

(56) References Cited

U.S. PATENT DOCUMENTS 2,005,361 A * 6/1935 Rollins ..... 2/195.1
5,058,211 A * 10/1991 Hanks ..... 2/206
5,351,343 A 10/1994 Harbison
5,381,559 A * 1/1995 Wakefield, III ..... 2/267
D366,352 S 1/1996 Shoemaker et al.
5,542,127 A 8/1996 Bezanis
D380,887 S 7/1997 Durodola
5,649,327 A 7/1997 Crewe
6,014,776 A 1/2000 DeVinzio
6,021,525 A 2/2000 Mertins
6,658,664 B1 12/2003 Verhoeven
2004/0163162 A1* 8/2004 Benziger ..... 2/411

* cited by examiner

*Primary Examiner*—John J. Calvert
*Assistant Examiner*—Alissa J. Tompkins
(74) *Attorney, Agent, or Firm*—Shlesinger, Arkwright & Garvey LLP.

(57) ABSTRACT

A head protective device incorporating a sweat band bandana having a front portion secured to a head protective device and the rear portion bandana unsecured. The bandana in the first position has the free ends of the bandana overlapping and stored withthin the head encircling member of the head protective device although the ends may also extend down for tying. A second position has the bandana extending downwardly from the head protective device and the bandana has the free ends tied behind the head for the purpose of securing the head protective device against accidental removal.

5 Claims, 4 Drawing Sheets

HEAD PROTECTIVE DEVICE INCORPORATING A SWEATBAND BANDANA

FIELD OF THE INVENTION

This invention relates to a head protective device which incorporates a sweatband bandana having two positions, one of which is a stored position in the head protective device and the other of which is a fold down position which is designed to keep the head protective device from accidentally being dislodged from the head.

BACKGROUND OF THE INVENTION

Bandanas have been used for centuries as a means for protection against the elements. Farmers have used bandanas to cover the head so as to prevent sunstroke. Women in particular have used bandanas as a decorative covering for the head as well as a protection against the wind and cold when used to cover the ears. Cowboys have used the bandana as a face covering to protect against gusts raised by wind or machinery. Bandanas have also been used to absorb sweat on the face and body when working. Bandanas also are used as handkerchiefs.

Wingfield U.S. Pat. No. 5,381,559, Bezanis U.S. Pat. No. 5,542,127, and DeVinzio U.S. Pat. No. 6,014,776 all relate to bandana headwear, but are not designed specifically as a head protective device incorporating a sweatband bandana.

Verhoeven U.S. Pat. No. 6,658,664 discloses a sweatband inside the front of a visor cap.

Harbison U.S. Pat. No. 5,351,343 shows the idea of having flaps which can be lowered and tied at the back of the head to maintain the cap on against windy conditions.

Shoemaker Design Pat. No. 366,352 and Durodola Design Pat. No. 380,887 show ties on the rear of the cap for securing the cap to the head.

Crewe U.S. Pat. No. 5,649,327 shows a protective panel which may be concealed within the cap and lowered for protection against the elements.

Mertins U.S. Pat. No. 6,021,525 provides a protective device which also may be removed from inside the cap to cover the back of the neck under adverse weather conditions.

OBJECTS AND SUMMARY OF THE INVENTION

It is an object of this invention to provide a head protective device incorporating a sweatband bandana in which the bandana can be used to secure the head protective device against accidental dislodgement.

A further object of this invention is to provide a head protective device which incorporates a sweatband bandana which can be fully stored within the head protective device and which can be lowered either fully or in part in order to provide full coverage to the forehead and the remainder of the head area in which sweat tends to accumulate.

Still a further object of this invention is to provide a head protective device which incorporates a sweatband bandana which can be easily manipulated as desired by the wearer.

Another object of this invention is to provide a head protective device incorporating a sweatband bandana which has substantial sweat absorbency qualities.

Yet a further object of this invention is to provide a head protective device incorporating a sweatband bandana which is easily and inexpensively manufactured.

Still a further object of this invention is to provide a sweatband bandana in various types of head protective devices such as hats, caps, helmets, and the like.

In summary, this invention is designed to incorporate a sweatband bandana within a head protective device which can be stored in an unobtrusive manner in a hat or the like and which may be readily displayed in order to provide security for the hat or the like or to provide additional protection to the forehead and other portions of the head under sweating conditions.

These and other objects of the invention will be apparent from the following description, including the drawings which are as follows.

FIG. 1 THROUGH FIG. 6(F)

Typically, as shown in the figures, the head protective device H may be a hat, cap, helmet, or head encircling band or strap. The head protective device comprises a head encircling member 2 having a front 4 and a rear 6. The head encircling member 2 has a closed link circular peripheral lip 8 as best shown in FIG. 3.

Figure 1:
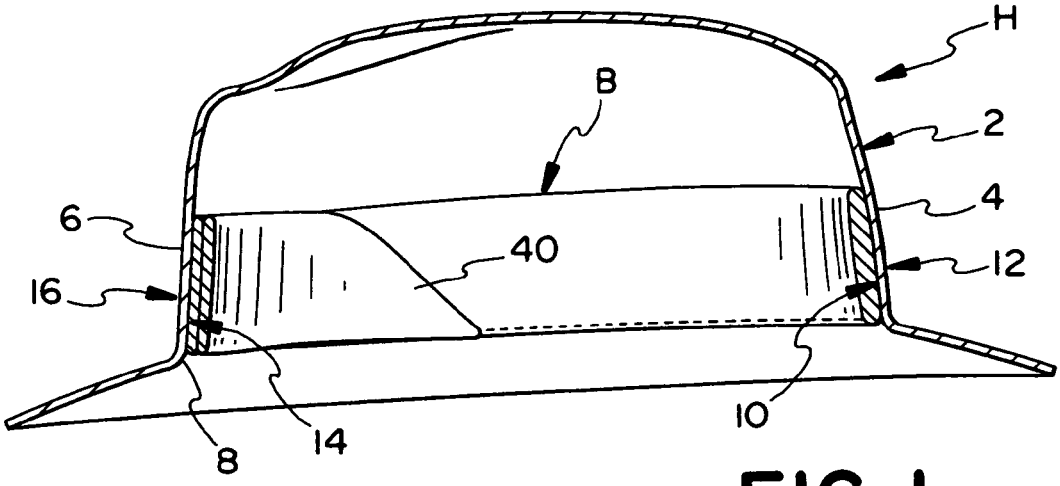
FIG. 1 is a cross sectional view of the head protective device incorporating the sweatband bandana of this invention.
Figure 2:
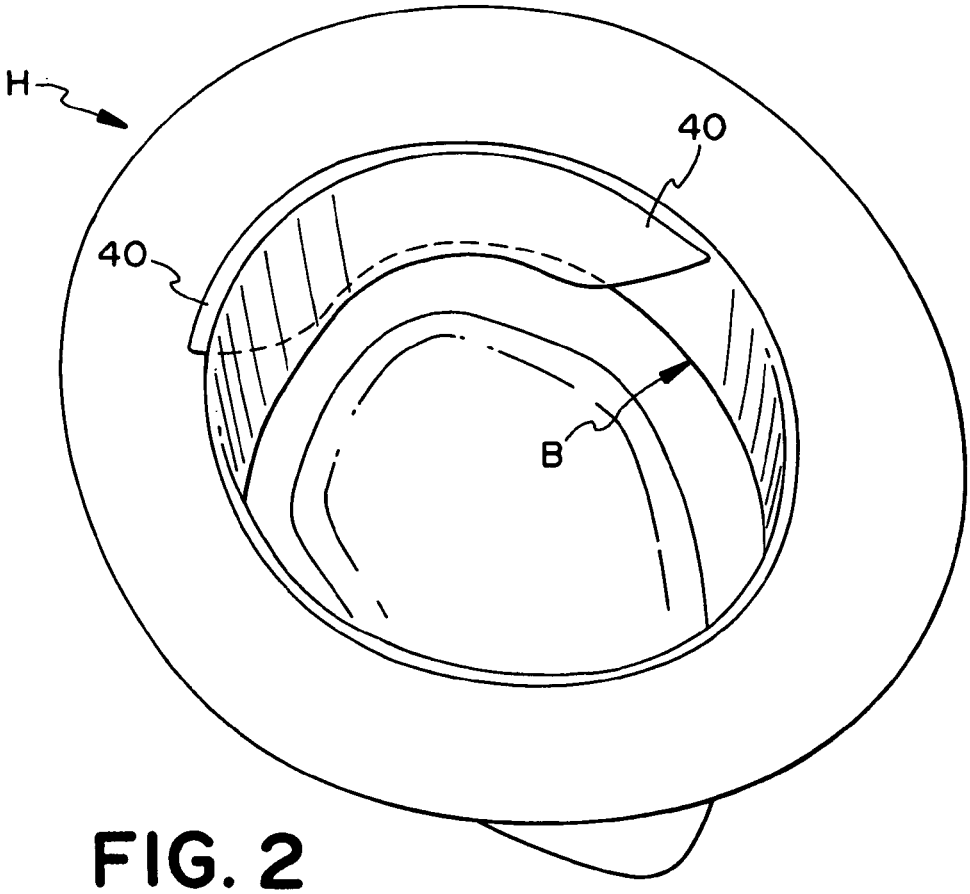
FIG. 2 is a bottom plan perspective view of this invention with a portion shown in phantom lines.

The peripheral lip 8 as best shown in FIG. 1 has a front inner surface 10, a front outer surface 12, a rear inner surface 14 and a rear outer surface 16.

The head protective device H incorporates a sweatband bandana B. The sweatband bandana as best shown in FIG. 1 has inner surface 18 and outer surface 20. The bandana B has an upper edge 22 and a lower edge 24.

Figure 3:
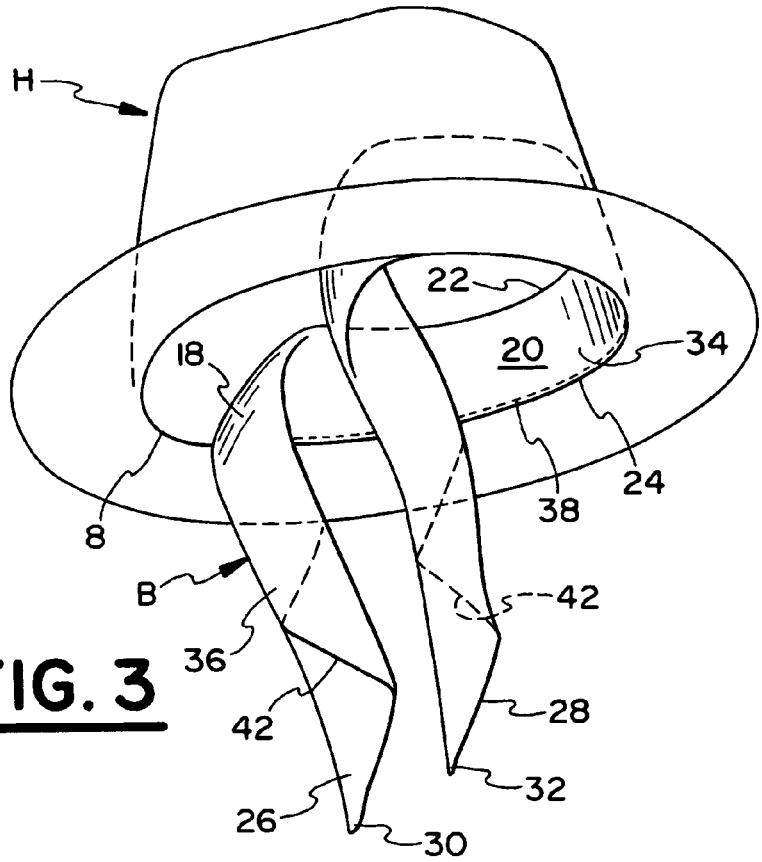
FIG. 3 is a perspective side elevational view with portions shown in phantom lines of this invention with portions of the sweatband bandana hanging down prior to tying.
Figure 4:
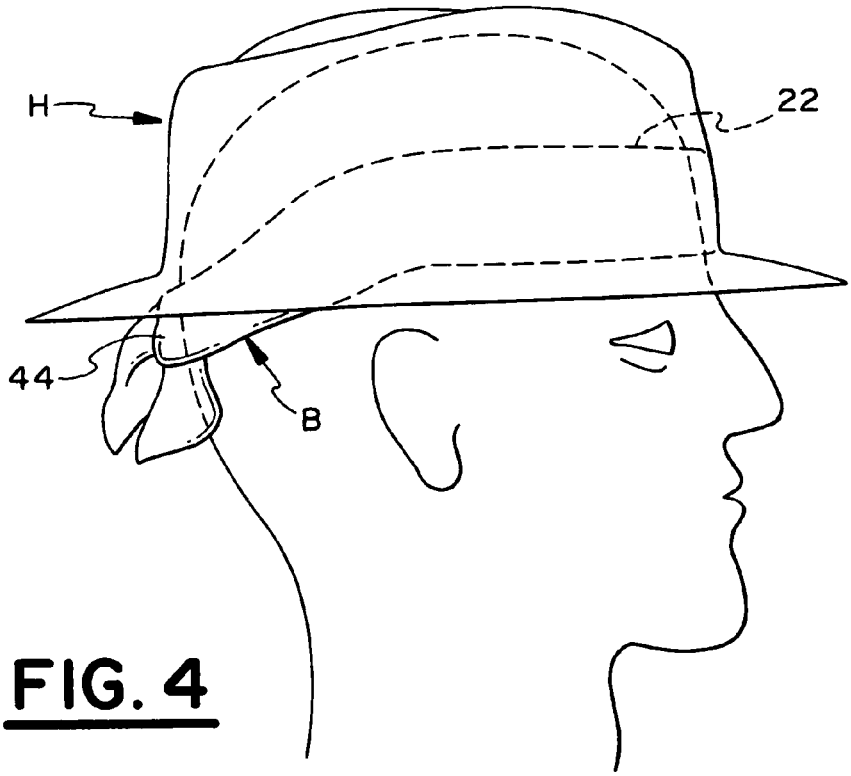
FIG. 4 is a side elevational view showing the invention as positioned on the head with portions shown in phantom lines and with the sweatband bandana tied on the back of the head in the first position.
Figure 5:
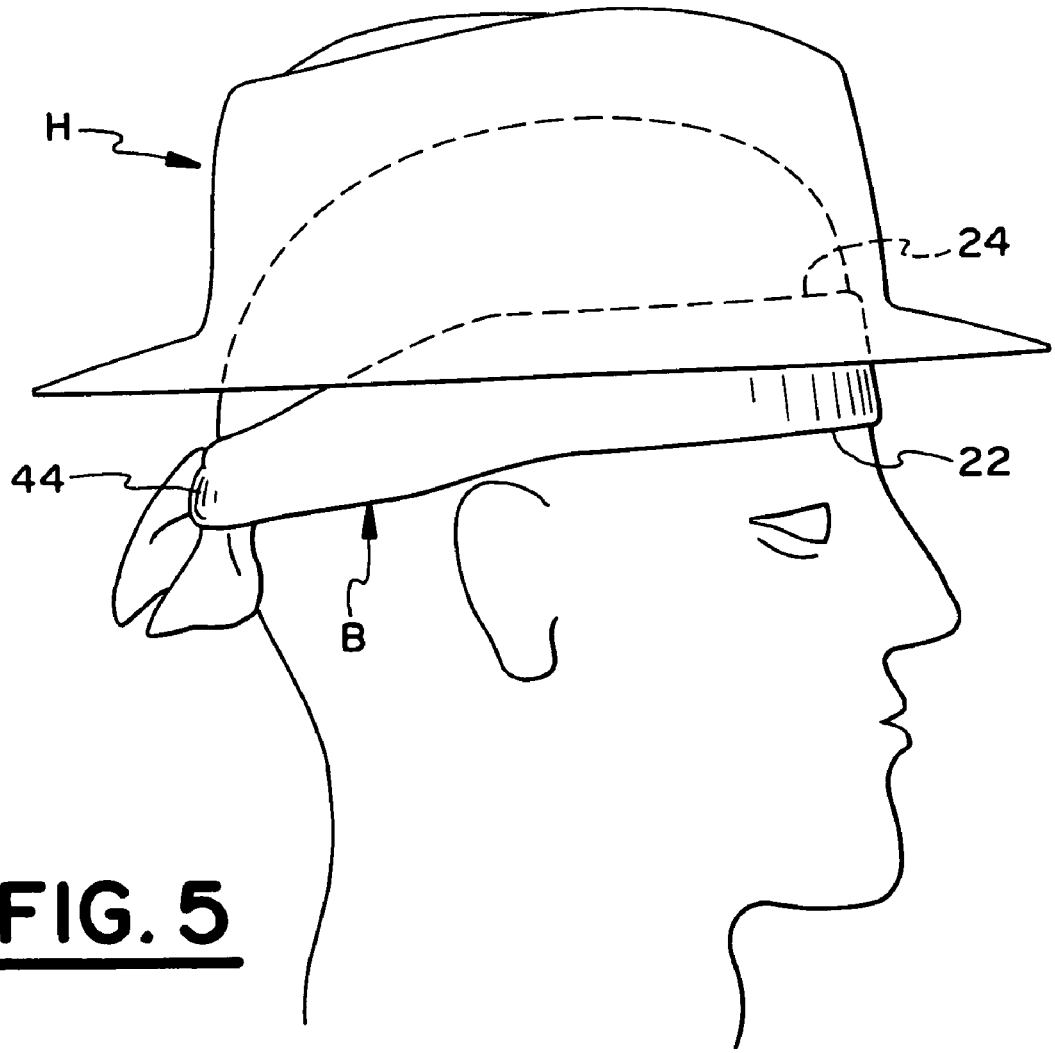
FIG. 5 is a side elevational view showing the invention as positioned on the head with portions shown in phantom lines and with the sweatband bandana tied on the back of the head in the second position.

As will be obvious from FIG. 3, the bandana B has a length substantially greater than the closed length circular peripheral lip 8. The bandana B has free ends 26 and 28, which are pointed at 30 and 32. The lower edge 24 of the bandana has a front portion 34 and a lower edge rear portion 36.

The front lower edge portion 34 of the bandana B is secured by stitching or other securement means 38.

In the first position of the bandana B, the free ends 26 and 28 overlap and are stored adjacent the inner surface 16 of the peripheral lip 8 as best shown in FIG. 1 at 40.

As shown in FIGS. 2 through 5, the bandana can be moved from a first stored position to a second down position in which the entire bandana B hangs down from the stitching 38 and over the forehead of the wearer. The free ends 26 and 28 showing folded edge 42 are tied at 44 to secure the head protective device H on the wearer.

It is to be noted that the stitching 38 only extends around the front portion of the head protective device H to leave the remaining portion of the bandana B unsecured to permit tying of the ends 26 and 28.

Figure 6A:
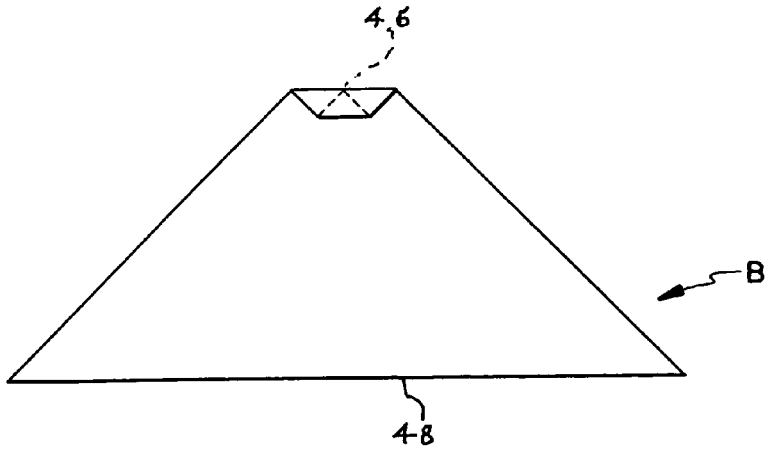
FIGS. 6A, 6B, 6C, 6D, 6E and 6F illustrate the manner in which the sweatband bandana is folded prior to securing to the head protective device.
Figure 6B:
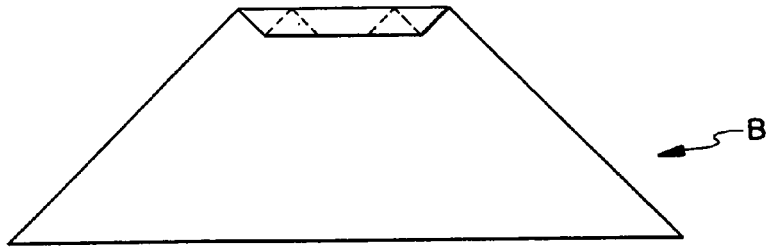
Figure 6C:
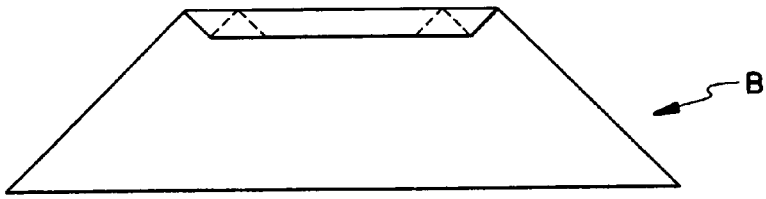
Figure 6D:
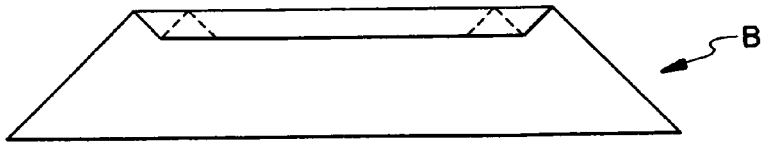
Figure 6E:
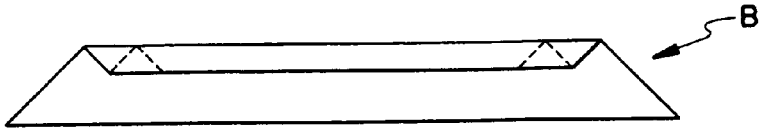
Figure 6F:
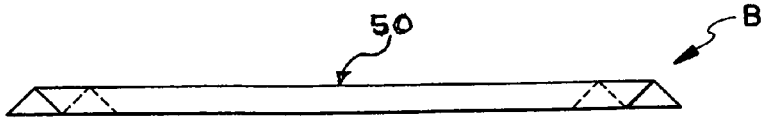

It is also to be noted that the bandana B, as best shown in FIGS. 6 through 6F, is multi-layered for better absorbing.

The bandana B is made from sweat absorbing material such as cotton cloth. The multi-layer is for better absorbency. It is to be further noted that the bandana B may be multicolored for decorative purposes as typical of most bandanas.

In order to obtain the maximum efficiency of the bandana B relative to absorbing sweat from the wearer of the head protecting device H, the bandana B as shown in FIG. 6(*a*) is triangular in shape and is folded in a series of steps from said apex 46 through outer base 48 as illustrated in FIGS. 6(A) through 6(F). The result of this folding is that the maximum amount of cloth winds up in that area where the maximum amount of sweating takes place; namely, the forehead. In FIGS. 6(A) through 6(F), seven folds or layers result at the central portion 50 of the bandana B.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A head protective device incorporating a folded sweatband bandana comprising:

a) a head encircling member having a front and a rear and having a closed length circular peripheral lip;

b) said peripheral lip having front and rear inner and outer surfaces;

c) said sweatband bandana having inner and outer surfaces and upper and lower edges;

d) said sweatband bandana having a length substantially greater than said closed length circular peripheral lip;

e) said sweatband bandana having an apex, a base, a central portion and free ends for tying behind said head;

f) said sweatband bandana having its lower edge having front and rear portions;

g) said sweatband bandana having only said lower edge front portion secured to said peripheral lip front inner surface;

h) said sweatband bandana having said lower edge rear portions unsecured to said peripheral lip rear inner surface;

i) said sweatband bandana having an up first position lying against said peripheral lip front and rear inner surfaces;

j) said sweatband bandana having a down second position with at least substantially all of said sweatband bandana extending down from said peripheral lip from head rear inner surfaces;

k) said sweatband bandana when in said first position having its free ends unsecured and overlapping;

l) said sweatband bandana when in said second position having its free ends tied together;

m) said folded sweatband bandana being a triangular piece of material;

n) said triangular piece of material having a series of folds from said apex to said base and having a thickness width increasing from its free ends to said control portion; and o) said central portion having the maximum seat absorbency of said folded sweatband bandana.

2. A head protective device incorporating a folded sweatband bandana as in claim 1 and wherein:

a) said sweatband bandana when in said second position has substantially all of its length extending down from said peripheral lip rear and front inner surfaces.

3. A head protective device incorporating a folded sweatband bandana as in claim 1 and wherein:

a) said sweatband bandana free ends are pointed for ease in tying.

4. A head protective device incorporating a folded sweatband bandana as in claim 1 and wherein:

a) said sweatband bandana is a sweat absorbing cotton material.

5. A head protective device incorporating a folded sweatband bandana as in claim 1, and wherein:

a) said secured lower edge front portion of said folded sweatband bandana includes stitching securing said folded bandana lower edge front portion to said peripheral lip from inner surface.

* * * * *